US006869003B2

(12) United States Patent
Waldeck et al.

(10) Patent No.: US 6,869,003 B2
(45) Date of Patent: Mar. 22, 2005

(54) CONVEYOR UNIT

(75) Inventors: Karl Waldeck, Etzenricht (DE); Ulli Bösl, Hirschau (DE)

(73) Assignee: BHS Corrugated Maschinen- und Anlagenbau GmbH, Weilherhammer (DE)

( * ) Notice: Subject to any disclaimer, the term of this patent is extended or adjusted under 35 U.S.C. 154(b) by 0 days.

(21) Appl. No.: 10/337,876

(22) Filed: Jan. 8, 2003

(65) Prior Publication Data

US 2003/0127486 A1 Jul. 10, 2003

(30) Foreign Application Priority Data

Jan. 8, 2002 (DE) ..... 102 00 356

(51) Int. Cl.[7] ..... B65H 20/00

(52) U.S. Cl. ..... 226/188; 226/186; 226/165; 271/114

(58) Field of Search ..... 226/188, 186, 226/185; 271/114, 116

(56) References Cited

U.S. PATENT DOCUMENTS

| | | | | |
|---|---|---|---|---|
| 3,785,543 A | * | 1/1974 | Lee | 226/188 |
| 3,806,014 A | | 4/1974 | Bolli | |
| 4,057,185 A | | 11/1977 | Slama et al. | |
| 4,549,485 A | * | 10/1985 | Nawrath | 101/219 |
| 5,344,058 A | * | 9/1994 | Baffo | 226/181 |
| 5,511,712 A | | 4/1996 | Holm et al. | |
| 5,727,724 A | * | 3/1998 | Dowling | 226/181 |
| 5,921,453 A | * | 7/1999 | Suzuki | 226/92 |
| 6,321,966 B1 | * | 11/2001 | Blanchard et al. | 226/11 |

FOREIGN PATENT DOCUMENTS

| | | |
|---|---|---|
| DE | 604868 | 10/1934 |
| DE | 19 35 303 | 3/1966 |
| DE | 12 30 642 | 4/1968 |
| DE | 6925166 | 6/1969 |
| DE | 69 19 440 | 9/1969 |
| DE | 4037096 | 6/1992 |
| DE | 93 20 690 | 1/1995 |
| DE | 3835060 | 2/1995 |
| DE | 4339766 | 2/1995 |
| GB | 2 157 250 | 10/1985 |

* cited by examiner

*Primary Examiner*—Eileen D. Lillis
*Assistant Examiner*—Evan Langdon
(74) *Attorney, Agent, or Firm*—Browdy and Neimark, P.L.L.C.

(57) ABSTRACT

A conveyor unit for conveying a web of material, in particular for conveying a web of corrugated board in a corrugating machine, comprises a machine frame; a delivery roller, which is lodged in the machine frame rotatably about a first axis of rotation; a drive for actuation of the delivery roller; a draw roller, which is lodged in the machine frame rotatably about a second axis of rotation, the first axis of rotation and the second axis of rotation being substantially parallel to each other, a nip for the web of material to pass through being formed between the delivery roller and the draw roller, the draw roller having a draw-roller-surface coefficient of friction which is selected so as to ensure power transmission from the draw roller to the web of material that rests thereon, and the delivery roller having a delivery-roller-surface coefficient of friction which is less than or equal to the draw-roller-surface coefficient of friction; and a torque transmission arrangement, which acts between the delivery roller and the draw roller for transmission of torque from the delivery roller to the draw roller, a free-wheel being disposed between the torque transmission arrangement and the draw roller.

36 Claims, 4 Drawing Sheets

CONVEYOR UNIT

BACKGROUND OF THE INVENTION

1. Field of the Invention

The invention relates to a conveyor unit for conveying a web of material, in particular for conveying a web of corrugated board in a corrugating machine.

2. Background Art

Conveying a web of corrugated board at a given velocity and accelerating the web to a certain velocity is of major importance in a corrugating machine so as to ensure that given portions of the web of corrugated board reach the processing devices to the moment. Upon changes of format in the lengthwise cutting and grooving unit, individual portions of the web must be accelerated for a gap to be produced, big enough to allow renewed positioning of the cutting tools. Conveyor units exist for conveying a portion of a web of corrugated board at a pre-determined velocity; they comprise a driven pair of rollers between which the web of corrugated board is passed. Permanent actuation of both rollers causes a comparatively high degree of wear.

SUMMARY OF THE INVENTION

It is an object of the invention to embody a conveyor unit for webs of material which will deliver the web of material with lowest possible wear.

This object is attained in a conveyor unit for conveying a web of material, in particular for conveying a web of corrugated board in a corrugating machine, comprising a machine frame; a delivery roller, which is lodged in the machine frame rotatably about a first axis of rotation; a drive for actuation of the delivery roller; a draw roller, which is lodged in the machine frame rotatably about a second axis of rotation, the first axis of rotation and the second axis of rotation being substantially parallel to each other, a nip for the web of material to pass through being formed between the delivery roller and the draw roller, the draw roller having a draw-roller-surface coefficient of friction, which is selected so as to ensure power transmission from the draw roller to the web of material that rests thereon, and the delivery roller having a delivery-roller-surface coefficient of friction, which is less than or equal to the delivery-roller-surface coefficient of friction; and a torque transmission arrangement, which acts between the delivery roller and the draw roller for torque transmission from the delivery roller to the draw roller, a free-wheel being disposed between the torque-transmission arrangement and the draw roller. The gist of the invention resides in providing the conveyor unit with a bottom delivery roller which is constantly actuated by a drive. A draw roller of a high coefficient of friction is provided, which is coupled with the delivery roller via a torque transmission arrangement with a free-wheel. The transmission ratio of the torque transmission device is selected such that the free-wheel acts when the velocity of the web of corrugated board, and thus the rotational speed of the draw roller, falls short of a pre-determined value.

Additional features and details of the invention will become apparent from the ensuing description of an exemplary embodiment, taken in conjunction with the drawing.

DESCRIPTION OF THE PREFERRED EMBODIMENT

Figure 1:
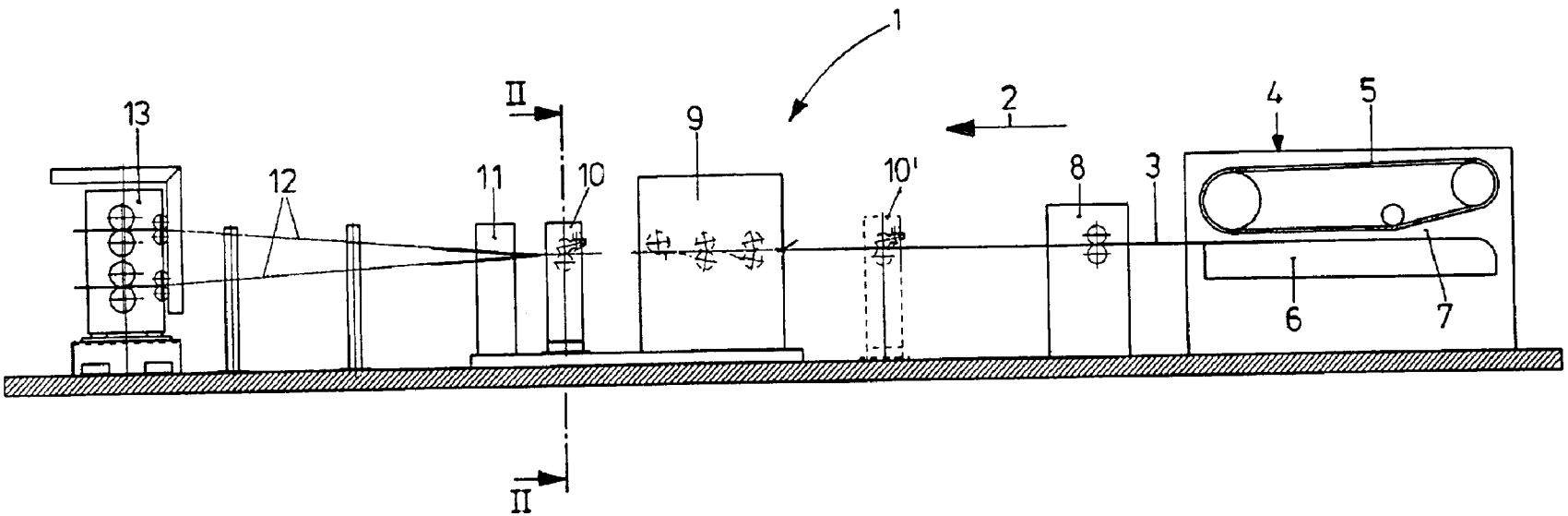
FIG. 1 is a diagrammatic view of a corrugating machine with a conveyor unit.

The corrugating machine 1, part of which is seen in FIG. 1, is described below as seen in the conveying direction 2. A web of corrugated board 3 is supplied by a heating and pulling device 4. The heating and pulling device 4 has a continuous drivable hold-down belt 5 which cooperates with a table 6 to define a nip 7 in which to compress the web of corrugated board 3. The heating and pulling device 4 is followed by a cross cutter 8 for cross-wise severing the web of corrugated board 3.

Disposed downstream of the cross cutter 8 is a lengthwise cutting and grooving unit 9. In this lengthwise cutting and grooving unit 9, grooves and longitudinal cuts, inclusive of a marginal cut, are applied to the web of corrugated board 3. Downstream of the lengthwise cutting and grooving unit 9, provision is made for a conveyor unit 10, which will be described in detail in the following and which serves for specific conveyance of the web of corrugated board 3 when the actual velocity $v_B$(actual) thereof falls short of a nominal velocity $v_B$(nominal). Downstream of the conveyor unit 10, provision is made for a shunt 11, dividing up various parts of the web of corrugated board 3 along two tables 12 and then supplying them to a double cross cutter 13 where the strips of corrugated board are cut into individual sections. In a wider sense, the term conveyor unit 10 means a unit which conveys a web of material or, possibly, sections of a web of material. It is also conceivable that several webs of material are conveyed side by side. Conveyor units in corrugating machines also imply automatic cutting and grooving machines.

Figure 2:
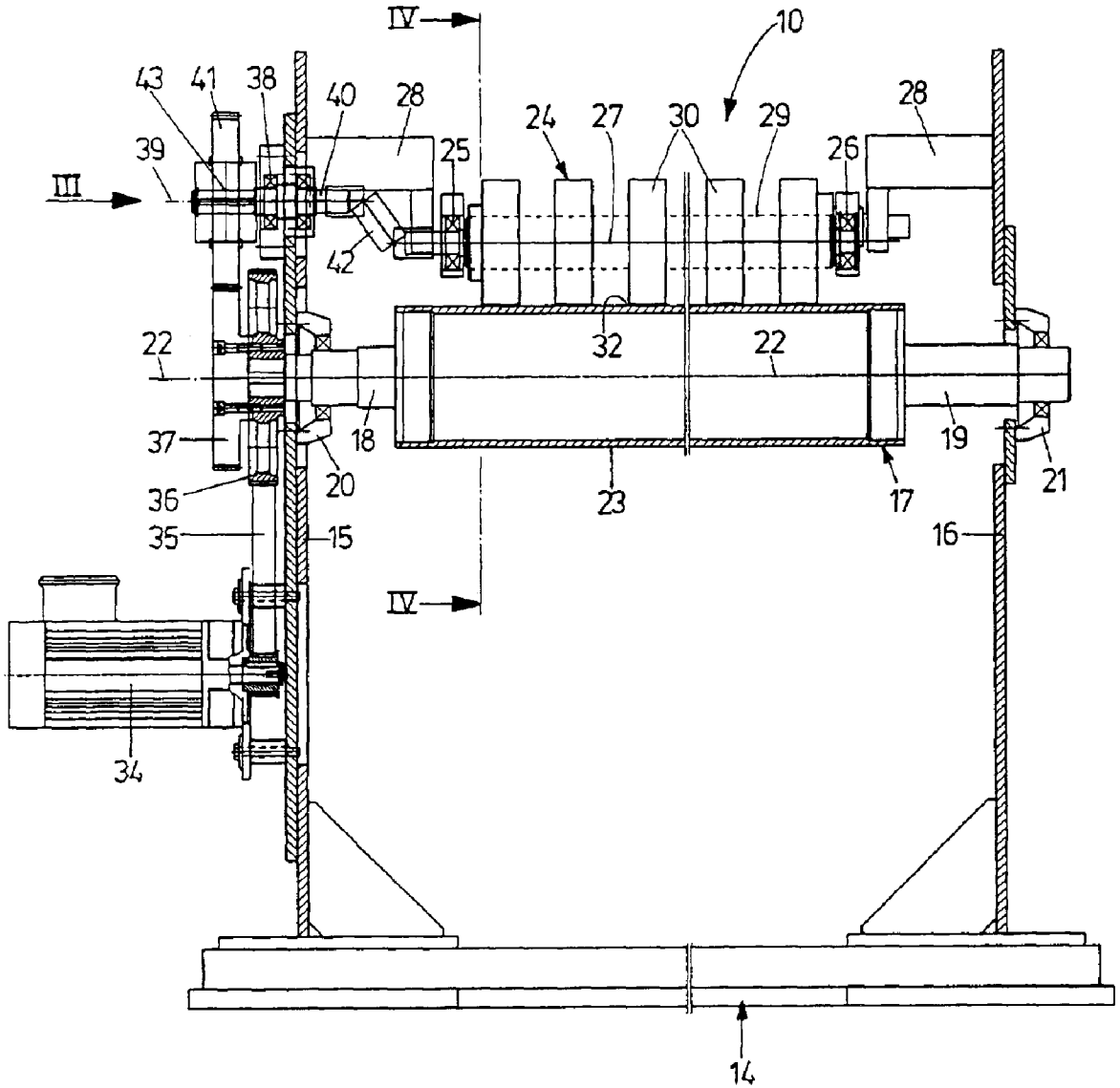
FIG. 2 is a section of the conveyor unit on the line II—II of FIG. 1.
Figure 3:
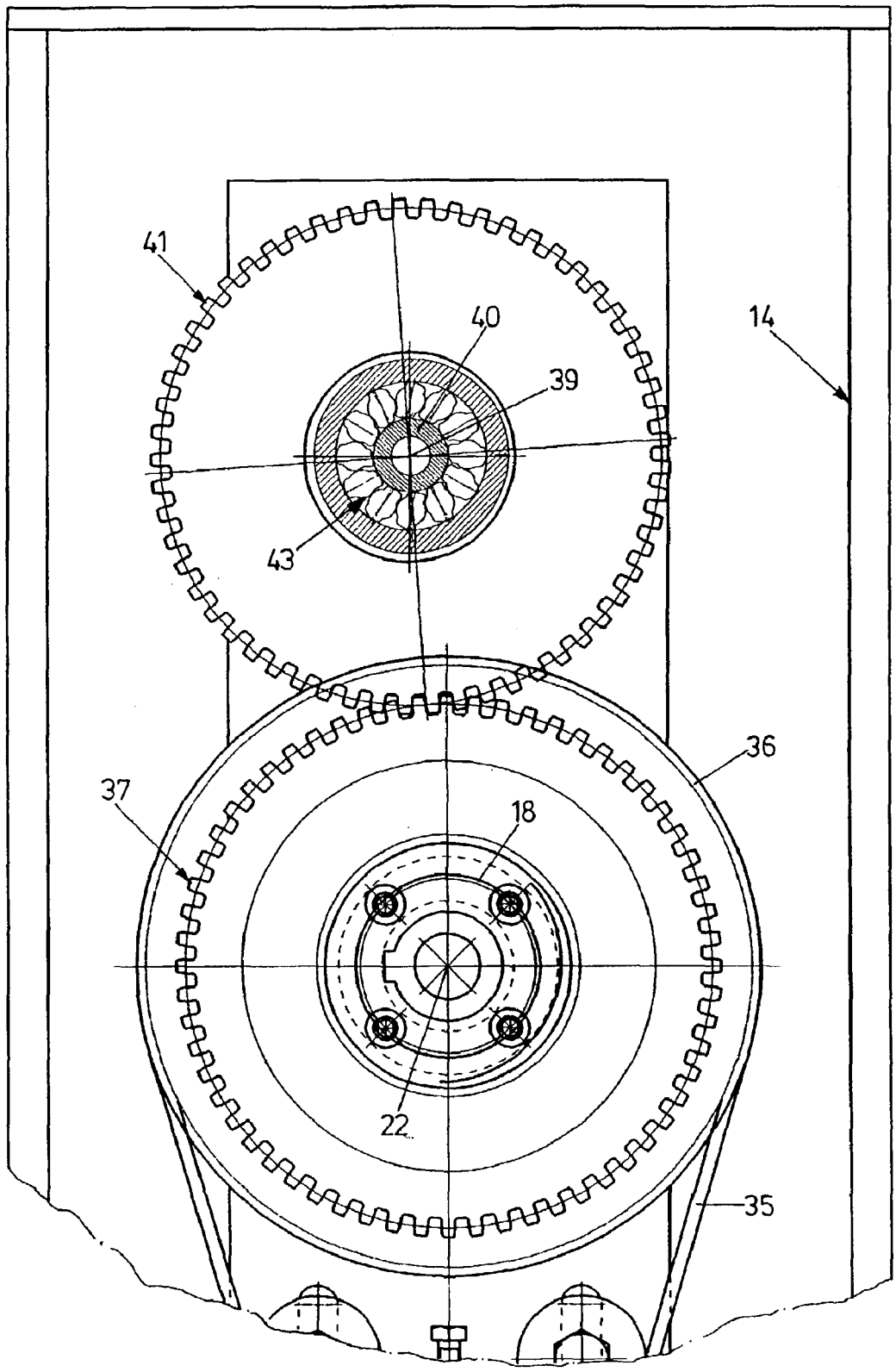
FIG. 3 is a plan view in accordance with the arrow III of FIG. 2.
Figure 4:
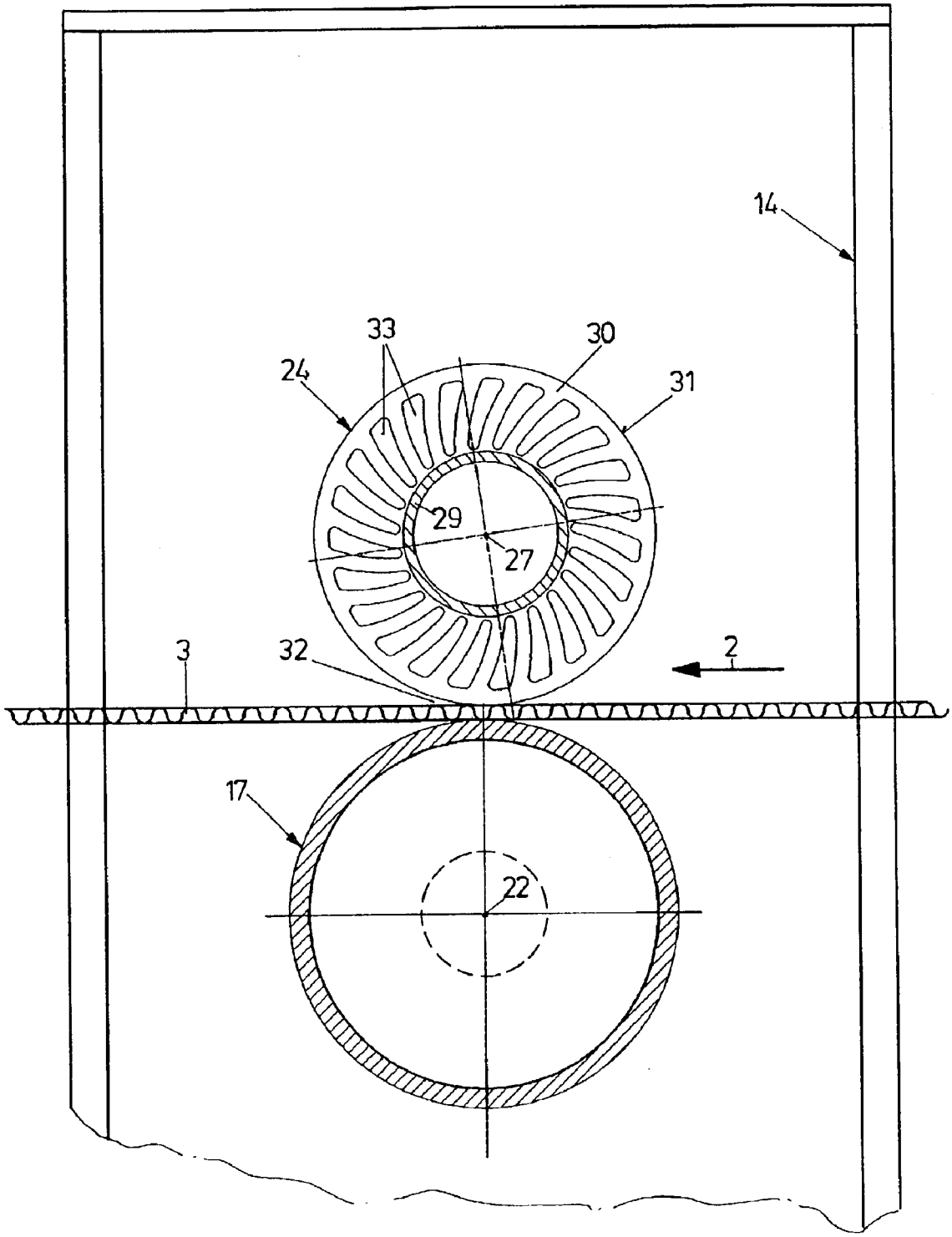
FIG. 4 is a sectional view on the line IV—IV of FIG. 2.

The following is a description of the detailed structure of the conveyor unit 10, taken in conjunction with FIGS. 2 to 4. The conveyor unit 10 comprises a machine frame 14 with lateral vertical walls 15 and 16 which are parallel to each other. Disposed between the walls 15 and 16 is a horizontal delivery roller 17 which is perpendicular to the conveying direction 2 and has two journals 18, 19 projecting on each end; the journals 18, 19 are run on bearings 20, 21 in the walls 15 and 16 rotatably about an axis of rotation 22. The delivery roller 17 is a hollow roller with a jacket 23 to each end of which are fixed the journals 18, 19. The jacket 23 is made of metal, in particular steel. The coefficient of static friction $\mu$ between the surface of the delivery roller 17 and a web of paper is in the range of $0.05 \leqq \mu \leqq 0.25$, in particular $\mu \approx 0.15$.

Above the delivery roller 17, a draw roller 24 is run on bearings 25, 26 for rotation about an axis of rotation 27. The bearings 25 and 26 are mounted on the walls 15 and 16 by arms 28. The draw roller 24 has a shaft 29 which extends from the bearing 25 to the bearing 26 and on which several rolls 30 are mounted, which are spaced apart axially. The rolls 30 are made of plastic material, in particular rubber, having a cylindrical surface 31. The draw-roller-surface coefficient of friction is selected so as to ensure power transmission from the roll 30, and thus from the draw roller 24, to the web of corrugated board 3. Consequently, the draw-roller-surface coefficient of friction is considerably greater than the delivery-roller-surface coefficient of friction. The coefficient of static friction $\mu$ between the surface of the draw roller 24 and a paper web is approximately $0.6 \leqq \mu \leqq 0.8$, in particular $\mu \approx 0.7$. Formed between the draw roller 24 and the delivery roller 17 is a nip 32 through which passes the web of corrugated board 3 while bearing against both the delivery roller 17 and the draw roller 24. The rolls 30 have uniformly distributed laminae 33, which extend substantially radially outwards and are closed in the radial direction. It is also possible to use solid rolls 30 without laminae 33. The axes of rotation 22 and 27 are parallel to each other.

A driving motor 34 is mounted on the wall 15; it is connected for torque transmission via a belt drive 35 to a pulley 36. The pulley 36 is joined to the journal 18. A gearwheel 37 is mounted on the journal 18 in vicinity to the pulley 36. The delivery roller 17, the pulley 36 and the gearwheel 37 are rotary about a common axis of rotation 22. Above the gearwheel 37, a driving shaft 40, which is rotary about an axis of rotation 39, is run on a bearing 38 in the wall 15. On its left end in FIG. 2, the driving shaft 40 has a gearwheel 41 which is connected to the driving shaft 40 and engages with the gearwheel 37. The opposite end of the driving shaft 40 is joined to an articulated shaft 42, the other end of which is again connected to the shaft 29. A free-wheel 43 is disposed between the gearwheel 41 and the driving shaft 40. The free-wheel 43 is a commercial free-wheel, allowing the gearwheel 41 to rotate in one sense relative to the driving shaft 40 and blocking it in the other sense. The axes 39 and 27 are parallel to one another and misaligned.

The following is a description of the mode of operation of the conveyor unit 10. During trouble-free conveyance, the web of corrugated board 3 has a nominal velocity $v_B$(nominal) within the conveyor unit 10. The web of corrugated board is primarily pulled through units downstream of the conveyor unit 10 and possibly accelerated. The delivery roller 17 is driven by the driving motor 34, the belt drive 35 and the pulley 36 so that it has a tangential rotational speed $v_T$ in the vicinity of the nip 32 and an associated angular velocity $\omega_T$. The delivery roller 17 is run at a higher speed i.e., the tangential rotational speed $v_T$ exceeds the nominal velocity $v_B$(nominal) of the web of corrugated board 3. $v_T/v_B$(nominal)>1 applies, in particular $v_T/v_B$(nominal)>1.01 and, by special advantage, $v_T/v_B$(nominal)>1.04. The draw roller 24 has a tangential rotational speed $v_Z$(nominal) and an associated angular velocity $\omega_Z$(nominal), with $v_Z$(nominal)≈$v_B$(nominal) i.e., the rolls 30 travel substantially free from slippage on the web of corrugated board 3. Consequently, the angular velocity of the driving shaft 40 is also $\omega_Z$(nominal). The gearwheel 41 is constantly driven by the gearwheel 37, with the transmission ratio being selected such that, if the web of corrugated board 3 is conveyed at the velocity $v_B$(nominal) and the driving shaft 40 has the angular velocity $\omega_Z$(nominal), no torque is transmitted from the gearwheel 41 to the driving shaft 40; consequently, the free-wheel 43 allows free relative rotation. This has the advantage that upon trouble-free conveyance of the web of corrugated board 3 at the desired velocity $v_B$(nominal), the rolls 30 are not driven and the wear of these rolls 30 is considerably reduced as compared to a situation in which the rolls 30 are permanently driven.

If for example a change of format in the lengthwise cutting and grooving unit 9 occasions a drop in velocity of the web of corrugated board 3 in the conveyor unit 10 and thus malfunction, an actual velocity $v_B$(actual) of the web of corrugated board 3 ensues, which is less than the nominal velocity $v_B$(nominal). The delivery roller 17, which is tightly joined to the driving motor 34, continues to run with slippage at a tangential rotational speed $v_T$ which exceeds the nominal velocity $v_B$(nominal) of the web of corrugated board 3. However, the draw roller 24 that rests on the web of corrugated board 3 slows down so that another tangential rotational speed $v_Z$(actual) and an associated angular velocity $\omega_Z$(actual) result, to which applies: $v_Z$(actual)≈$v_B$(actual)<$v_B$(nominal). The gearwheel 41 is driven by the gearwheel 37 at a speed that is independent of the velocity of the web of corrugated board 3. Due to the reduction in velocity of the web of corrugated board 3, the angular velocity of the driving shaft 40 decreases. The transmission ratio of the gearwheels 37 and 41 is selected such that, if the ratio a that the actual velocity $v_B$(actual) bears to the nominal velocity $v_B$(nominal) undershoots a pre-determined threshold $a_{LIM}$ and the angular velocity of the driving shaft 40 undershoots a certain threshold, the free-wheel takes action and the shaft 29 is driven by the driving motor 34. The following applies to $a_{LIM}$: $a_{LIM}<1$, $a_{LIM}\leqq 0.99$ and, by special advantage, $a_{LIM}\approx 0.98$. It is important that $a_{LIM}$ is in a range outside the customary fluctuation of the conveying velocities $v_B$(nominal) during troublefree operation. This is intended to prevent the free-wheel 43 from being permanently switched on and the shaft 29 from being driven in the case of usual fluctuations in the conveying velocity of the web of corrugated board 3. Apart from wear symptoms, this would result in the system building up. If the fluctuations in velocity of the web of corrugated board 3 in trouble-free operation are in the range of approximately 1 percent, then it is reasonable that the drive of the draw roller 24 is switched on when the velocity of the web of corrugated board 3 falls short by more than 2 percent, corresponding to a factor $a_{LIM}=0.98$. If the fluctuations in velocity of the web of corrugated board 3 in trouble-free operation are inferior, $a_{LIM}$ may be in a range closer to 1, for example $a_{LIM}=0.99$. If the fluctuations are greater, $a_{LIM}$ must be in a range more remote from 1.

A special advantage of the conveyor unit 10 resides in that no electronic control is required. In trouble-free operation the draw roller 24 is not actuated, its wear being comparatively low. If the velocity of the web of corrugated board 3 falls short of a pre-determined threshold, torque is exerted by the driving motor 34 via the free-wheel 43 on the draw roller 24 which continues to convey the web of corrugated board 3 at least at the given limit velocity. This is important for example in case of a change of format in the corrugating machine 1. For the change of format to be put into practice, the web of corrugated board 3 is cut through by the cross cutter 8. The portion of the web of corrugated board 3 that is upstream of the cross cutter 8 is accelerated so that a gap is produced for the lengthwise cutting and grooving unit 9. This gap is needed for renewed positioning of the cutting tools in the unit 9. If the gap is too small, because the portion of the web of corrugated board had not been delivered rapidly enough, the renewed positioning of the tools must be disrupted, which produces a back-up. The corresponding delivery of the section of the web of corrugated board is implemented by the conveyor unit 10, which pulls the portion of the web of corrugated board out of the unit 9. It is also possible to dispose the conveyor unit upstream of the unit 9, which is roughly outlined by the reference numeral 10'.

What is claimed is:

1. A conveyor unit for conveying a web of material, in particular for conveying a web of corrugated board in a corrugating machine, comprising a machine frame (14);

a delivery roller (17), which is lodged in the machine frame (14) rotatably about a first axis of rotation (22);

a driving motor (34) for actuation of the delivery roller (17);

a draw roller (24), which is lodged in the machine frame (14) rotatably about a second axis of rotation (27), the first axis of rotation (22) and the second axis of rotation (27) being substantially parallel to each other, a nip (32) for the web of material (3) to pass through being formed between the delivery roller (17) and the draw roller (24), the draw roller (24) having a draw-roller-surface coefficient of friction, which is selected so as to ensure power transmission from the draw roller (24) to the web of material (3) that rests thereon, and the delivery roller (17) having a delivery-roller-surface coefficient of friction, which is less than to the draw-roller-surface coefficient of friction; and a torque transmission arrangement, which acts between the delivery roller (17) and the draw roller (24) for torque transmission from the driving motor (34) and the delivery roller (17) to the draw roller (24), a free-wheel (43) being disposed between the torque-transmission arrangement and the draw roller (24).

2. A conveyor unit according to claim 1, wherein the draw roller (24) comprises a rotatably mounted draw-roller shaft (29) with at least one roll (30) fixed thereto.

3. A conveyor unit according to claim 1, wherein, during trouble-free operation, a. the web of material (3) is conveyable at a predetermined nominal velocity $v_B$(nominal);

b. the delivery roller (17) is drivable at a predetermined tangential rotational speed $v_T$ and an associated angular velocity $\omega_T$; and c. the draw roller (24) has a tangential rotational speed $v_Z$ and an associated angular velocity $\omega_Z$ so that $v_Z \approx v_B$ (nominal) applies.

4. A conveyor unit according to claim 3, wherein $v_T/v_B$ (nominal)>1, in particular $v_T/v_B$(nominal)$\geqq$1.01, and by special advantage $v_T/v_B$(nominal)≈1.04, applies to the ratio that the tangential rotational speed $v_T$ of the delivery roller bears to the nominal velocity $v_B$(nominal) of the web of material (3).

5. A conveyor unit according to claim 3, wherein the torque transmission arrangement is such that, in case the actual velocity $v_B$(actual) of the web of material (3) is less than the nominal velocity $v_B$(nominal) of the web of material (3), torque is transmitted via the free-wheel (43) to the draw roller (24) if $v_Z/v_B$(nominal)<1, in particular $v_Z/v_B$(nominal) $\leqq$0.99, and by special advantage $v_Z/v_B$(nominal)≈0.98, applies to the ratio of the tangential rotational speed $v_Z$ that the draw roller (24) bears to the nominal velocity $v_B$(nominal) of the web of material.

6. A conveyor unit according to claim 1, wherein at least the surface of the draw roller (24) consists of rubber.

7. A conveyor unit according to claim 1, wherein at least the surface of the delivery roller (17) consists of metal, in particular of bright steel.

8. A conveyor unit for conveying a web of material, in particular for conveying a web of corrugated board in a corrugating machine, comprising a machine frame (14);

a delivery roller (17), which is lodged in the machine frame (14) rotatably about a first axis of rotation (22);

a drive (34) for actuation of the delivery roller (17);

a draw roller (24), which is lodged in the machine frame (14) rotatably about a second axis of rotation (27), the first axis of rotation (22) and the second axis of rotation (27) being substantially parallel to each other, a nip (32) for the web of material (3) to pass through being formed between the delivery roller (17) and the draw roller (24), the draw roller (24) having a draw-roller-surface coefficient of friction, which is selected so as to ensure power transmission from the draw roller (24) to the web of material (3) that rests thereon, and the delivery roller (17) having a delivery-roller-surface coefficient of friction, which is less than the draw-roller-surface coefficient of friction; and a torque transmission arrangement, which acts between the delivery roller (17) and the draw roller (24) for torque transmission from the delivery roller (17) to the draw roller (24), a free-wheel (43) being disposed between the torque-transmission arrangement and the draw roller (24), wherein the torque transmission arrangement is a gear-wheel drive, comprising a first gearwheel (37), which is connected with the delivery roller (17) for torque transmission, and a second gearwheel (41), which is connected with the draw roller (24) for torque transmission, the first gearwheel (37) and the second gearwheel (41) being in mesh.

9. A conveyor unit according to claim 8, wherein the draw roller (24) comprises a driving shaft (40), which is connected with the draw roller (24) for torque transmission, the free-wheel (43) being disposed between the second gear-wheel (41) and the driving shaft (40).

10. A conveyor unit according to claim 8, wherein the draw roller (24) comprises a rotatably mounted draw-roller shaft (29) with at least one roll (30) fixed thereto.

11. A conveyor unit according to claim 8, wherein, during trouble-free operation, a. the web of material (3) is conveyable at a predetermined nominal velocity $v_B$(nominal);

b. the delivery roller (17) is drivable at a predetermined tangential rotational speed $v_T$ and an associated angular velocity $\omega_T$; and c. the draw roller (24) has a tangential rotational speed $v_Z$ and an associated angular velocity $\omega_Z$ so that $v_Z \approx v_B$ (nominal) applies.

12. A conveyor unit according to claim 11, wherein $v_T/v_B$(nominal)>1, in particular $v_T/v_B$(nominal)$\geqq$1.01, and by special advantage $v_T/v_B$(nominal)≈1.04, applies to the ratio that the tangential rotational speed vT of the delivery roller bears to the nominal velocity $v_B$(nominal) of the web of material (3).

13. A conveyor unit according to claim 11, wherein the torque transmission arrangement is such that, in case the actual velocity $v_B$(actual) of the web of material (3) is less than the nominal velocity $v_B$(nominal) of the web of material (3), torque is transmitted via the free-wheel (43) to the draw roller (24) if $v_Z/v_B$(nominal)<1, in particular $v_Z/v_B$(nominal) $\leqq$0.99, and by special advantage $v_Z/v_B$(nominal)≈0.98, applies to the ratio of the tangential rotational speed $v_Z$ that the draw roller (24) bears to the nominal velocity $v_B$(nominal) of the web of material.

14. A conveyor unit according to claim 8, wherein at least the surface of the draw roller (24) consists of rubber.

15. A conveyor unit according to claim 8, wherein at least the surface of the delivery roller (17) consists of metal, in particular of bright steel.

16. A conveyor unit for conveying a web of material, in particular for conveying a web of corrugated board in a corrugating machine, comprising a machine frame (14);

a delivery roller (17), which is lodged in the machine frame (14) rotatably about a first axis of rotation (22);

a driving motor (34) for actuation of the delivery roller (17);

a draw roller (24), which is lodged in the machine frame (14) rotatably about a second axis of rotation (27), the first axis of rotation (22) and the second axis of rotation (27) being substantially parallel to each other, a nip (32) for the web of material (3) to pass through being formed between the delivery roller (17) and the draw roller (24), the draw roller (24) having a draw-roller-surface coefficient of friction, which is selected so as to ensure power transmission from the draw roller (24) to the web of material (3) that rests thereon, and the delivery roller (17) having a delivery-roller-surface coefficient of friction, which is less than or equal to the draw-roller-surface coefficient of friction; and a torque transmission arrangement, which acts between the delivery roller (17) and the draw roller (24) for torque transmission from the driving motor (34) and the delivery roller (17) to the draw roller (24), a free-wheel (43) being disposed between the torque-transmission arrangement and the draw roller (24), wherein, during trouble-free operation, the web of material (3) is conveyable at a predetermined nominal velocity $v_B$(nominal);

the delivery roller (17) is drivable at a predetermined tangential rotational speed $v_T$ and an associated angular velocity $\omega_T$; and the draw roller (24) has a tangential rotational speed $v_Z$ and an associated angular velocity $\omega_Z$ so that $v_Z \approx v_B$ (nominal) applies, wherein $v_T/v_B(\text{nominal}) \geqq 1.01$, applies to the ratio that the tangential rotational speed $v_T$ of the delivery roller bears to the nominal velocity $v_B$(nominal) of the web of material (3), and wherein the torque transmission arrangement is such that, in case the actual velocity $v_B$(actual) of the web of material (3) is less than the nominal velocity $v_B$(nominal) of the web of material (3), torque is transmitted via the free-wheel (43) to the draw roller (24) if $v_Z/v_B(\text{nominal}) \leqq 0.99$, applies to the ratio of the tangential rotational speed $v_Z$ that the draw roller (24) bears to the nominal velocity $v_B$(nominal) of the web of material.

17. A conveyor unit according to claim 16, wherein the torque transmission arrangement is a gearwheel drive.

18. A conveyor unit according to claim 17, wherein the gearwheel drive comprises a first gearwheel (37), which is connected with the delivery roller (17) for torque transmission, and a second gearwheel (41), which is connected with the draw roller (24) for torque transmission, the first gearwheel (37) and the second gearwheel (41) being in mesh.

19. A conveyor unit according to claim 18, wherein the draw roller (24) comprises a driving shaft (40), which is connected with the draw roller (24) for torque transmission, the free-wheel (43) being disposed between the second gearwheel (41) and the driving shaft (40).

20. A conveyor unit according to claim 16, wherein the draw roller (24) comprises a rotatably mounted draw-roller shaft (29) with at least one roll (30) fixed thereto.

21. A conveyor unit according to claim 16, wherein by special advantage $v_T/v_B(\text{nominal}) \approx 1.04$.

22. A conveyor unit according to claim 16, wherein torque is transmitted via the free-wheel (43) to the draw roller (24) if by special advantage $v_Z/v_B(\text{nominal}) \approx 0.98$.

23. A conveyor unit according to claim 16, wherein at least the surface of the draw roller (24) consists of rubber.

24. A conveyor unit according to claim 16, wherein at least the surface of the delivery roller (17) consists of metal, in particular of bright steel.

25. A conveyor unit for conveying a web of material, in particular for conveying a web of corrugated board in a corrugating machine, comprising a machine frame (14);

a delivery roller (17), which is lodged in the machine frame (14) rotatably about a first axis of rotation (22) and wherein at least the surface of the delivery roller (17) consists of metal;

a driving motor (34) for actuation of the delivery roller (17);

a draw roller (24), which is lodged in the machine frame (14) rotatably about a second axis of rotation (27) and wherein at least the surface of the draw roller (24) consists of rubber, the first axis of rotation (22) and the second axis of rotation (27) being substantially parallel to each other, a nip (32) for the web of material (3) to pass through being formed between the delivery roller (17) and the draw roller (24), the draw roller (24) having a draw-roller-surface coefficient of friction, which is selected so as to ensure power transmission from the draw roller (24) to the web of material (3) that rests thereon, and the delivery roller (17) having a delivery-roller-surface coefficient of friction, which is less than the draw-roller-surface coefficient of friction; and a torque transmission arrangement, which acts between the delivery roller (17) and the draw roller (24) for torque transmission from the driving motor (34) and the delivery roller (17) to the draw roller (24), a free-wheel (43) being disposed between the torque-transmission arrangement and the draw roller (24).

26. A conveyor unit according to claim 25, wherein the torque transmission arrangement is a gearwheel drive.

27. A conveyor unit according to claim 26, wherein the gearwheel drive comprises a first gearwheel (37), which is connected with the delivery roller (17) for torque transmission, and a second gearwheel (41), which is connected with the draw roller (24) for torque transmission, the first gearwheel (37) and the second gearwheel (41) being in mesh.

28. A conveyor unit according to claim 27, wherein the draw roller (24) comprises a driving shaft (40), which is connected with the draw roller (24) for torque transmission, the free-wheel (43) being disposed between the second gearwheel (41) and the driving shaft (40).

29. A conveyor unit according to claim 25, wherein the draw roller (24) comprises a rotatably mounted draw-roller shaft (29) with at least one roll (30) fixed thereto.

30. A conveyor unit according to claim 25, wherein, during trouble-free operation, the web of material (3) is conveyable at a predetermined nominal velocity $v_B$(nominal);

the delivery roller (17) is drivable at a predetermined tangential rotational speed $v_T$ and an associated angular velocity $\omega_T$; and the draw roller (24) has a tangential rotational speed $v_Z$ and an associated angular velocity $\omega_Z$ so that $v_Z \approx v_B$ (nominal) applies.

31. A conveyor unit according to claim 29, wherein $v_T/v_B(\text{nominal}) > 1$, in particular $v_T/v_B(\text{nominal}) \geqq 1.01$, and by special advantage $v_T/v_B(\text{nominal}) \approx 1.04$, applies to the ratio that the tangential rotational speed $v_T$ of the delivery roller bears to the nominal velocity $v_B$(nominal) of the web of material (3).

32. A conveyor unit according to claim 29, wherein the torque transmission arrangement is such that, in case the actual velocity $v_B$(actual) of the web of material (3) is less than the nominal velocity $v_B$(nominal) of the web of material (3), torque is transmitted via the free-wheel (43) to the draw roller (24) it $v_Z/v_B(\text{nominal})<1$, in particular $v_Z/v_B(\text{nominal}) \leqq 0.99$, and by special advantage $v_Z/v_B(\text{nominal}) \approx 0.98$, applies to the ratio of the tangential rotational speed $v_Z$ that the draw roller (24) bears to the nominal velocity $v_B$(nominal) of the web of material.

33. A conveyor unit according to claim 25, wherein at least the surface of the delivery roller (17) consists of bright steel.

34. A conveyor unit according to claim 1, wherein the torque transmission arrangement is a gearwheel drive.

35. A conveyor unit according to claim 33, wherein the gearwheel drive comprises a first gearwheel (37), which is connected with the delivery roller (17) for torque transmission, and a second gearwheel (41), which is connected with the draw roller (24) for torque transmission, the first gearwheel (37) and the second gearwheel (41) being in mesh.

36. A conveyor unit according to claim 34, wherein the draw roller (24) comprises a driving shaft (40), which is connected with the draw roller (24) for torque transmission, the free-wheel (43) being disposed between the second gearwheel (41) and the driving shaft (40).

* * * * *